US008608093B2

(12) United States Patent
Girlinger et al.

(10) Patent No.: US 8,608,093 B2
(45) Date of Patent: Dec. 17, 2013

(54) FUEL INJECTOR HAVING A HIGH-PRESSURE INLET

(75) Inventors: Gerhard Girlinger, Leonding (AT); Marcela Haberlova, Linz (AT); Arthur Eberhart, Kirchdorf an der Krems (AT)

(73) Assignee: Robert Bosch GmbH, Stuttgart (DE)

( * ) Notice: Subject to any disclaimer, the term of this patent is extended or adjusted under 35 U.S.C. 154(b) by 378 days.

(21) Appl. No.: 13/003,197

(22) PCT Filed: May 15, 2009

(86) PCT No.: PCT/EP2009/055891

§ 371 (c)(1), (2), (4) Date: Jan. 7, 2011

(87) PCT Pub. No.: WO2010/006828

PCT Pub. Date: Jan. 21, 2010

(65) Prior Publication Data

US 2011/0114762 A1 May 19, 2011

(30) Foreign Application Priority Data

Jul. 14, 2008 (DE) ..... 10 2008 040 383

(51) Int. Cl.

| | |
|---|---|
| ***B05B 1/30*** | (2006.01) |
| ***F02M 61/00*** | (2006.01) |
| ***F02M 63/00*** | (2006.01) |
| ***F02M 39/00*** | (2006.01) |
| ***F02M 41/00*** | (2006.01) |

(52) U.S. Cl.

USPC ..... 239/584; 239/533.2; 123/468; 123/470

(58) Field of Classification Search

USPC ..... 239/533.3, 533.1, 533.2, 584; 123/456, 123/468, 469, 470

See application file for complete search history.

(56) References Cited

U.S. PATENT DOCUMENTS

| | | | | |
|---|---|---|---|---|
| 6,470,855 | B1 * | 10/2002 | Frank et al. | 123/456 |
| 6,497,219 | B2 * | 12/2002 | Natsume | 123/468 |
| 2003/0080217 | A1 * | 5/2003 | Boecking | 239/533.2 |
| 2003/0089793 | A1 * | 5/2003 | Grieb et al. | 239/88 |
| 2008/0282879 | A1 | 11/2008 | Arnold et al. | |

FOREIGN PATENT DOCUMENTS

| | | | |
|---|---|---|---|
| DE | 10152230 | A1 | 4/2003 |
| EP | 1273792 | A2 | 1/2003 |
| EP | 1927751 | A1 | 6/2008 |
| WO | 0112980 | A1 | 2/2001 |

* cited by examiner

*Primary Examiner* — Justin Jonaitis

(74) *Attorney, Agent, or Firm* — Michael Best & Friedrich LLP

(57) ABSTRACT

The invention relates to a fuel injector for the operation of an internal combustion engine, having an injector body. An inlet bore of the injector body connects a conical pressure connection to a valve chamber for supplying highly pressurized fuel. The valve chamber is placed along a longitudinal center axis of the injector body and above a nozzle needle. According to the invention, the inlet bore further has a fan-shaped contour starting at the conical pressure connection along the extension thereof, the contour having a fan angle and a variable cross-section in the shape similar to an elongated hole.

7 Claims, 3 Drawing Sheets

FUEL INJECTOR HAVING A HIGH-PRESSURE INLET

CROSS-REFERENCE TO RELATED APPLICATION

This application is a 35 USC 371 application of PCT/EP 2009/055891 filed on May 15, 2009.

BACKGROUND OF THE INVENTION

1. Field of the Invention

The invention relates to a fuel injector for the operation of an internal combustion engine, having an injector body in which an inlet bore connects a conical pressure connection with a valve chamber for delivering fuel that is at high pressure, and the valve chamber is placed along a longitudinal center axis of the injector body and above a nozzle needle.

2. Description of the Prior Art

From German Patent Disclosure DE 101 52 230 A1, a fuel injector is already known in the injector body of which a valve chamber is in communication with a pressure connection via an inlet bore. In the region of the intersections between the valve chamber and the inlet bore, bellied portions of the cross section are also provided, in order to reduce the notch stresses in this region and thus overall to attain greater pressure-proofness of the injector body.

From German Patent Disclosure DE 44 46 071 A1, a method for designing high-pressure intersections, for instance in fuel injectors, is also known. To reduce the stresses in the intersection region, an inlet bore to a valve chamber is embodied in oval form. As a result, a better stress distribution in the inlet bore can be attained, and thus the component load can be minimized.

A disadvantage of the known prior art is that with the present systems, the production effort and expense are high, and the incident stresses in the region of the intersections can be reduced further by improving their geometry.

OBJECT AND SUMMARY OF THE INVENTION

It is therefore the object of the present invention to create a fuel injector in which intersections between the inlet bore and the valve chamber are embodied in such a way that stresses in this region are reduced, while at the same time optimal utilization of material prevails.

The invention includes the technical teaching that the inlet bore, beginning at the pressure connection, along its length has a fanlike contour with a defined fan angle and a variable cross section of oblong-slotlike form. By this provision, an increased pressure area is generated in the axial direction, which leads to a stress reduction in the vicinity of the intersection of the inlet bore and the valve chamber. Thus a shift in the maximum stress can be attained, out of the region of the intersecting lines into the axial vicinity of the inlet bore, and as a result the machining effort and expense in the vicinity of the intersections can be reduced. Moreover, by the fanlike design of the inlet bore, optimal utilization of material is achieved.

The term "fanlike" in this case means that the bore widens its cross section, beginning at the pressure connection, in the direction of the valve chamber along a defined angle. The term "oblong-slotlike form" means that the variable cross section of the inlet bore has the form of an oblong bore, and based on the machining of the inlet bore, edges can protrude into this oblong-slotlike form and can correspondingly change this form slightly.

In a further advantageous feature of the invention, the fanlike contour is formed by at least two bores, and the center axes of the respective outer bores, beginning at a connecting axis of the pressure connection and valve chamber each extend by half the fan angle, pivoted in the direction of the valve chamber. By this provision, the fanlike contour of the inlet bore can be created at a low production cost, because in the simplest case two bores are placed, which to form the fanning out of the inlet are pivoted accordingly by half the fan angle relative to the connecting axis located between the valve chamber and the pressure connection.

In a refinement of the invention, the fanlike contour is formed by a plurality of bores, in order to obtain an oblong-slotlike cross section. For the sake of simplicity, this embodiment of the fan bore can be made by a milling cutter, which beginning at a connecting axis to the valve chamber is pivoted about the point of the pressure connection by half the fan angle in each case. However, making a contour by means of electrochemical forming or rough-machining erosion is also conceivable.

In a further advantageous feature of the invention, the respective outer bores of the fanlike contour of the inlet bore, with their center axes, are not located outside a respective angle, equal to a tangent, of a cross section of the valve chamber. It is advantageous in this respect that the outer regions of the inlet bore are not located too far outside the valve chamber, and thus no overly great deflection of the flowing fuel in the direction of the valve chamber is required.

In a refinement of the invention, the fanlike contour of the inlet bore, on its end toward the valve chamber, has a rounded end with the form of a concavely curved annular portion. As a result, the inflow of fuel to the valve chamber at the end of the inlet bore is improved further.

In a further advantageous feature of the invention, the fan angle is in the range from 20° to 30°. This range of values defines an optimal widening of the inlet bore.

In a refinement of the invention, the fanlike contour of the inlet bore, in the direction of the longitudinal center axis of the injector body, has a length in the range from 2 mm to 5 mm. In this range of values, a sufficient cross section for delivering fuel via the inlet bore is achieved.

In a further embodiment of the invention, the valve chamber has an oblong-slotlike or elliptical cross section, and outer bores, defining the cross section, are offset outward from the longitudinal center axis of the injector body by an amount of 0.1 mm to 0.2 mm. By this provision, an enlargement of the valve chamber is attained, as a result of which the fanlike contour of the inlet bore can be correspondingly widened as well.

Further provisions that improve the invention will be described in further detail below together with the description of a preferred embodiment of the invention.

BRIEF DESCRIPTION OF THE DRAWINGS

The invention will be described in detail below in conjunction with the accompanying drawings, in which.

DESCRIPTION OF THE PREFERRED EMBODIMENT

Figure 1:
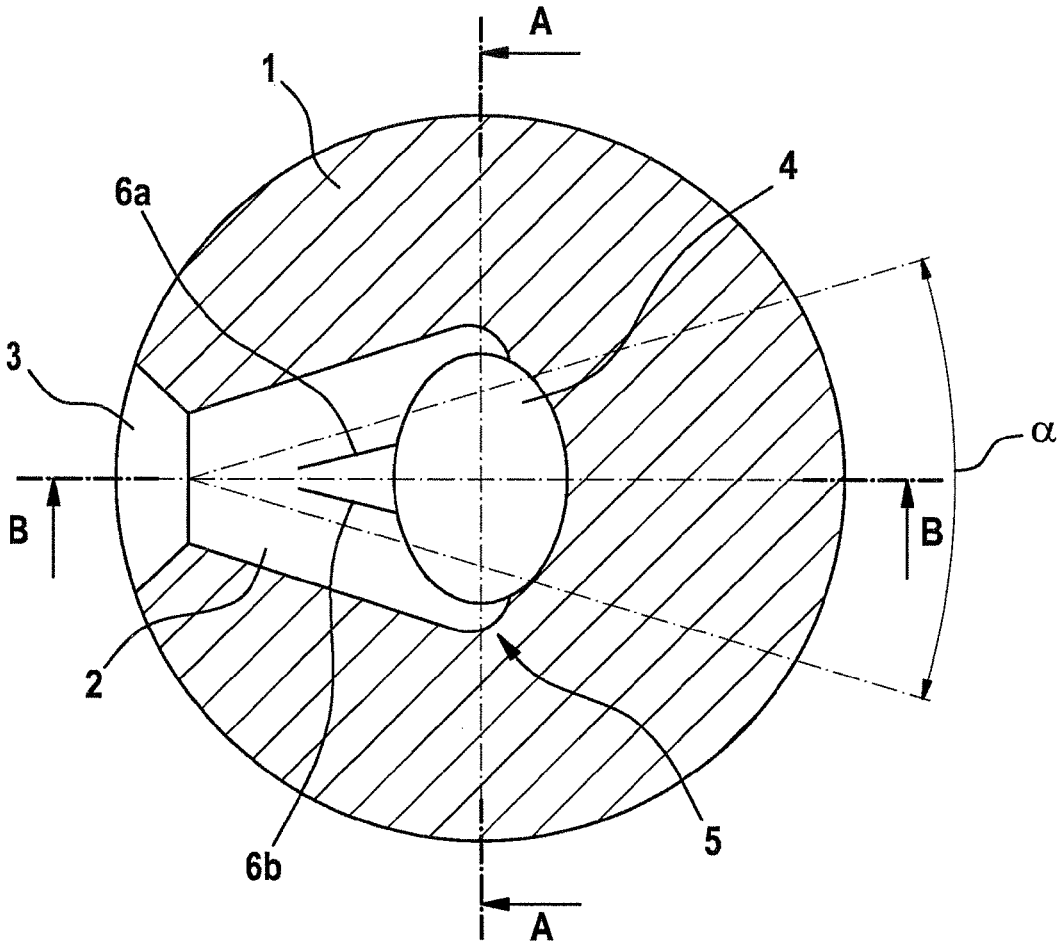
FIG. 1 is a sectional view of a fuel injector of the invention, the section being made in the vicinity of the inlet bore perpendicular to the longitudinal center axis of the injector body.

In FIG. 1, a sectional view of the fuel injector of the invention can be seen; the section has been placed perpendicular to a longitudinal center axis of the injector body 1. In this sectional view, an inlet bore 2 connects a conical pressure connection 3 with a valve chamber 4. As can be seen from FIG. 1, the valve chamber 4 is embodied elliptically. To create an increased pressure area in the axial direction of the inlet bore 2, the pressure area is embodied in fanlike fashion and, beginning at the conical pressure connection 3, extends at the angle α in the direction of the valve chamber 4. In the embodiment shown, an inlet bore 2 of this kind is created by making three individual bores in the injector body 1. The first bore is extended, beginning at the conical pressure connection 3, rectilinearly in the direction of the longitudinal center axis of the injector body 1. The two outer bores 10 are created, again beginning at the pressure connection 3, by drilling in pivoted fashion by half the fan angle α each in the direction of the valve chamber 4. On its end, the inlet bore 2 furthermore has a rounded end 5, with the form of a concavely curved annular portion, in order to improve the flow properties into the valve chamber 4 in this region. The inlet bore 2 furthermore has edges 6*a*-6*d*, which are created as a result of the overlap of the individual bores for forming the inlet bore 2.

Figure 2:
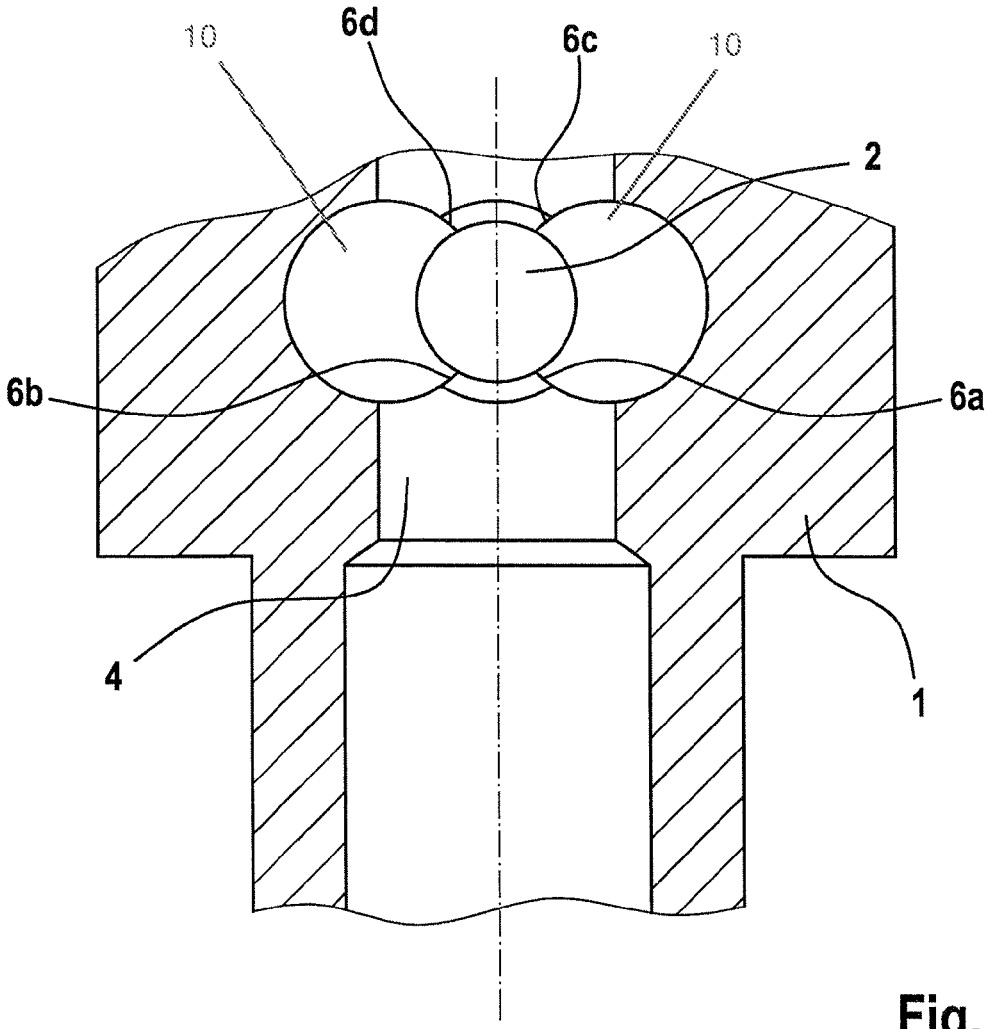
FIG. 2 is a sectional view of the fuel injector, taken along the line A-A in FIG. 1.
Figure 3:
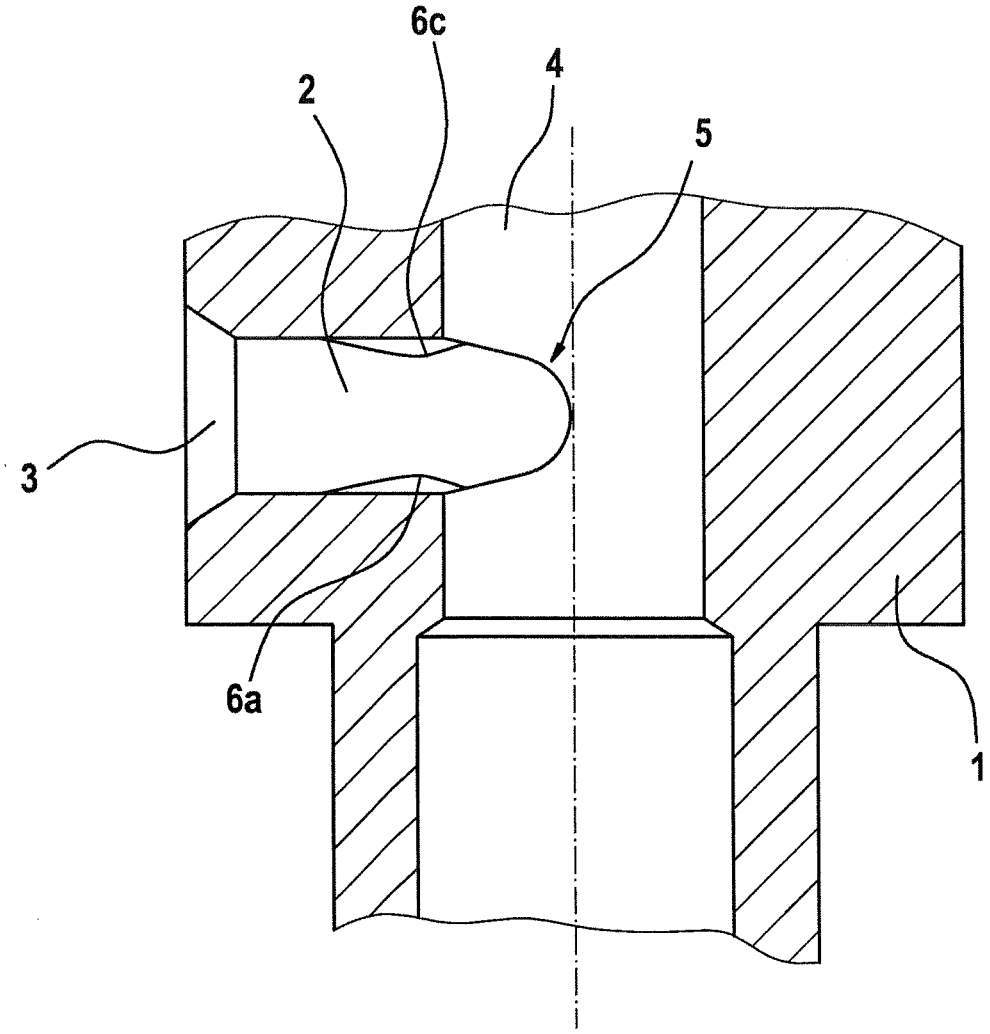
FIG. 3 is a sectional view of the fuel injector, taken along the line B-B in FIG. 1.

In FIGS. 2 and 3, further sectional views of the fuel injector of the invention can be seen, from which in particular the geometry of the inlet bore 2 can be seen.

FIG. 2 shows a sectional view of the fuel injector, taken along the line A-A in FIG. 1.

FIG. 3 shows a sectional view of the fuel injector, taken along the line B-B in FIG. 1.

The foregoing relates to the preferred exemplary embodiment of the invention, it being understood that other variants and embodiments thereof are possible within the spirit and scope of the invention, the latter being defined by the appended claims.

The invention claimed is:

1. A fuel injector for an internal combustion engine, the fuel injector comprising:

an injector body in which an inlet bore connects a conical pressure connection with a valve chamber for delivering fuel at a high pressure, the valve chamber being placed along a longitudinal center axis of the injector body, wherein the inlet bore, beginning at the conical pressure connection, along its length has a fanlike contour with a fan angle and a variable cross section of oblong-slotlike form, wherein the fanlike contour of the inlet bore, on its end toward the valve chamber, has a rounded end with a form of a concavely curved annular portion.

2. The fuel injector as defined by claim 1, wherein the fanlike contour is formed by at least two bores, and center axes of respective outer bores, beginning at a connecting axis of the pressure connection and valve chamber each extend by half the fan angle, pivoted in a direction toward the valve chamber.

3. The fuel injector as defined by claim 2, wherein the fanlike contour is formed by a plurality of bores, in order to obtain an oblong-slotlike cross section.

4. The fuel injector as defined by claim 2, wherein the respective outer bores of the fanlike contour of the inlet bore, with their center axes, are not located outside a respective angle, equal to a tangent, of a cross section of the valve chamber.

5. The fuel injector as defined by claim 1, wherein the fan angle is in a range from 20° to 30°.

6. The fuel injector as defined by claim 1, wherein the fanlike contour of the inlet bore, in a direction of the longitudinal center axis of the injector body, has a length in the range from 2 mm to 5 mm.

7. The fuel injector as defined by claim 6, wherein the valve chamber has an oblong-slotlike or elliptical cross section, and outer bores of the inlet bore, defining the cross section of the valve chamber, are offset outward from the longitudinal center axis of the injector body by an amount of 0.1 mm to 0.2 mm.

* * * * *